US005151569A

United States Patent [19]

Suh

[11] Patent Number: 5,151,569

[45] Date of Patent: Sep. 29, 1992

[54] MICROWAVE COOKER HAVING A ROTARY STIRRER AND A ROTARY FOOD SUPPORT

[75] Inventor: Young S. Suh, Suweon, Rep. of Korea

[73] Assignee: Samsung Electronics Co., Ltd., Kyungki, Rep. of Korea

[21] Appl. No.: 703,729

[22] Filed: May 21, 1991

[30] Foreign Application Priority Data

May 29, 1990 [KR] Rep. of Korea ..... 90-7403[U]

[51] Int. Cl.[5] ..... H05B 6/78

[52] U.S. Cl. ..... 219/10.55 F; 219/10.55 E

[58] Field of Search ..... 219/10.55 E, 10.55 F, 219/10.55 R

[56] References Cited

U.S. PATENT DOCUMENTS

| | | | |
|---|---|---|---|
| 4,283,614 | 8/1981 | Tanaka et al. | 219/10.55 B |
| 4,636,605 | 1/1987 | Berend et al. | 219/10.55 F |
| 4,751,357 | 6/1988 | Boulard | 219/10.55 F |
| 4,804,812 | 2/1989 | Tanaka et al. | 219/10.55 F |
| 4,937,418 | 6/1990 | Boulard | 219/10.55 F |
| 4,980,529 | 12/1990 | Bolton | 219/10.55 M |
| 5,043,547 | 8/1991 | Lee | 219/10.55 B |

*Primary Examiner*—Philip H. Leung

*Attorney, Agent, or Firm*—Burns, Doane, Swecker & Mathis

[57] ABSTRACT

A microwave cooker has a microwave stirrer and a food-supporting shaft, both of which are driven by a common motor. The food-supporting shaft is removable to increase the available cooking area. The microwave stirrer and the food-supporting shaft have a common axis which extends vertically.

13 Claims, 4 Drawing Sheets

MICROWAVE COOKER HAVING A ROTARY STIRRER AND A ROTARY FOOD SUPPORT

FIELD OF THE INVENTION

The invention relates to a rotator structure including a driving shaft and a driven shaft having objects, such as a barbecue, inserted thereon in an electronic range, and more particularly to a rotator structure for forcing a driving shaft to be rotated along with a stirrer and facilitating the mounting of the driving shaft to the driven shaft, separately.

BACKGROUND OF THE INVENTION

FIG. 4 shows a conventional electronic range structure, wherein reference numeral 41 is foodstuffs to be cooked, 42 is a rotary shaft for cooking foodstuffs, 43 is a motor for rotating the rotary shaft, 44 is a stirrer, and 45 is an air inlet.

Rotary shaft 42 having foodstuffs to be cooked is arranged transversely in heating compartment 40 and is connected to motor 43.

On the other hand, a conventional electronic range was usually provided with a motor-driven cooling fan (not shown) for a magnetron 47 having a high voltage transformer.

Therefore, the cooling fan introduces air through air inlet 45 to cool the high voltage transformer as well as to be supplied into heating compartment 40. At that time, the air stream serves to rotate vane shaped stirrer 44, so that microwaves generated by magnetron 47 are dispersed into cooking compartment 40. Rotary shaft 42 is rotated to cook foodstuffs 41 inserted thereon. Furthermore, air streams are discharging out of cooking compartment 40 with vapor produced from foodstuff 41 being heated.

However, the structure of such a conventional electronic range had has several disadvantages. That is, the making of air streams powerful enough to rotate stirrer 44 must increase the capacity of a cooling motor, but there is concern that microwaves produced by such a powerful stirrer 44 could be leaked externally through air inlet 45. Furthermore, since a rotary shaft was installed transversely in the heating chamber, the available cooking space was being narrowed.

Accordingly, it is an object of the invention to provide a rotator structure for directly rotating a stirrer therewith.

It is other object of the invention to provide a rotator structure for facilitating the mounting of a driven shaft to a driving shaft, detachably, to use a cooking space in a cooking compartment, effectively.

SUMMARY OF A PREFERRED EMBODIMENT OF THE INVENTION

In order to resolve these problems, the invention comprises a rotator structure provided with a driving shaft and a driven shaft, wherein the driving shaft is provided with a mounting portion having an upper hollow portion formed therein to mount the driving shaft to a motor shaft, a lower hollow portion extending therein from the middle portion to the lower portion of the mounting portion, a supporting portion of a circular disk extended around the outer circumference of the middle portion in the mounting portion, a coupling groove coupled at the upper portion of the supporting means with a stirrer and a coupling means cut out at a predetermined width from a predetermined position on the lower portion of the driving shaft to the predetermined height with being extended oppositive to the rotation direction of a motor. The driven shaft is provided with an upper portion inserted into the lower hollow portion of the driving shaft, a fixing means inserted into the coupling means to prevent the separation of the upper portion from the driving shaft, and means for retaining objects to be cooked.

According to the invention, a driving shaft rotates a stirrer, thereby minimizing the capacity of the driving shaft as well as avoiding microwave leakage because of the removal of an air inlet portion formed in a ceiling portion. Also, it is easy for a driven shaft to be removably attached to the driving shaft to use the space of a heating chamber to the utmost dependent upon the sizes or types of objects to be cooked.

BRIEF DESCRIPTION OF THE DRAWINGS

The invention will be described in detail by reference to the attached drawings, wherein.

DETAILED DESCRIPTION OF THE INVENTION

Figure 3:
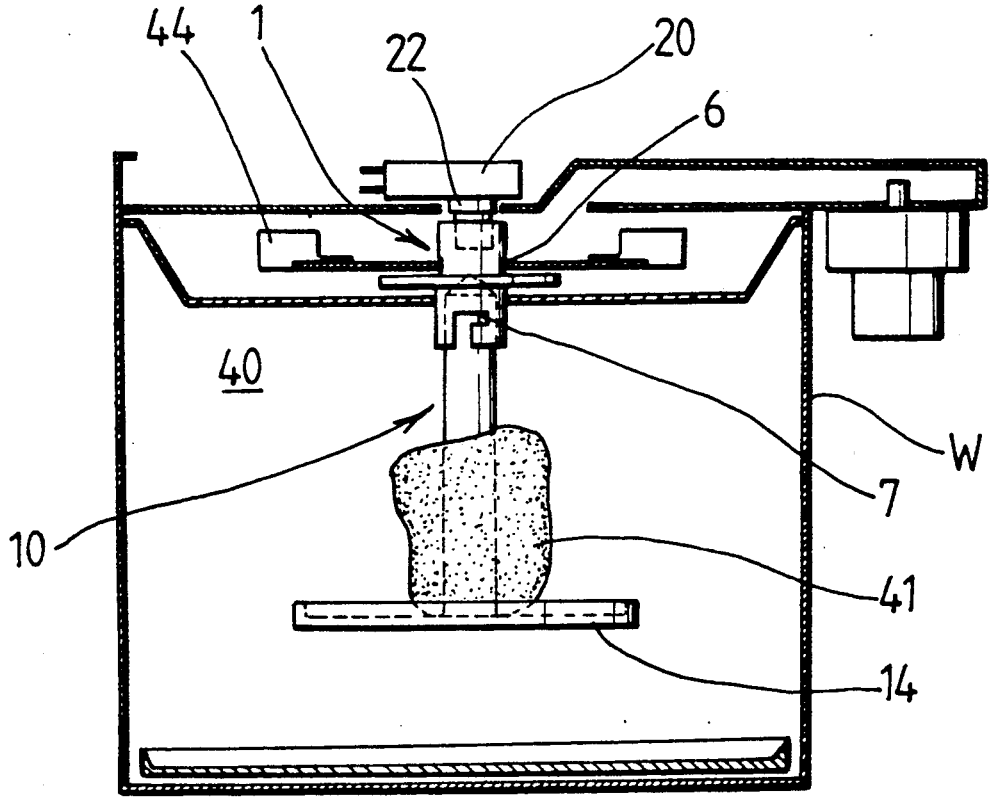
FIG. 3 is a side view of an electronic range employing a rotator structure according to the invention.
Figure 4:
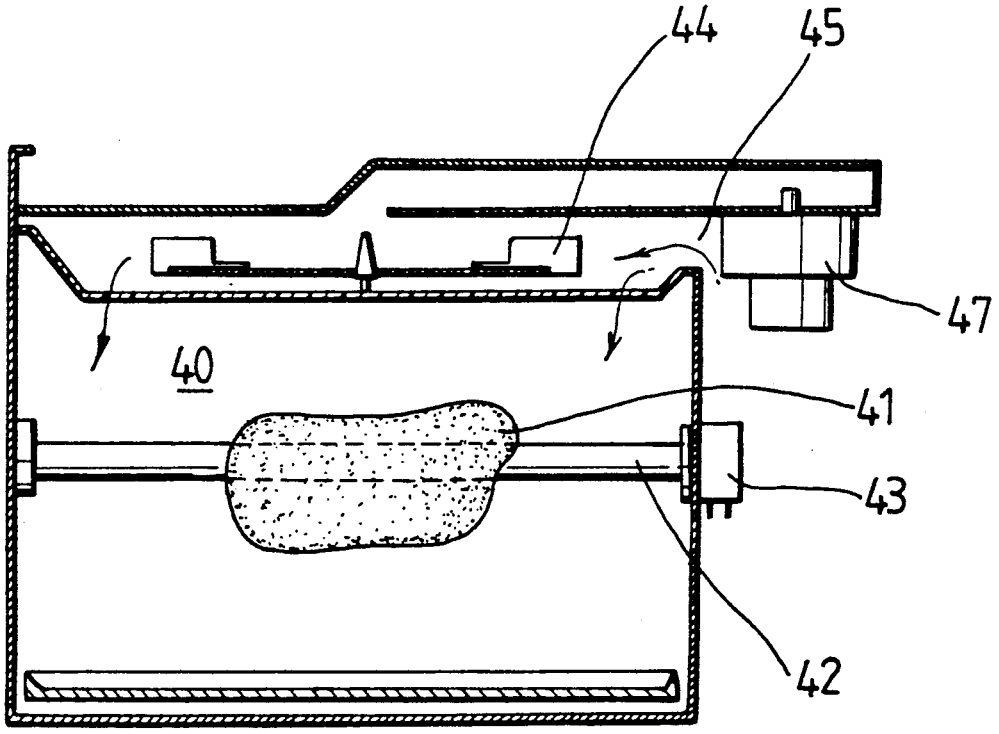
FIG. 4 (Prior Art)
FIG. 4 is a side view of an electronic range employing a conventional rotary shaft.

Rotating motor 20 as shown in FIG. 3 is properly mounted at a predetermined position over an upper plate 25A of a ceiling portion 25 which overlie cooking compartment 40. Rotating motor shaft 22 extends downward to project through the plate 25*a*.

Figure 1:
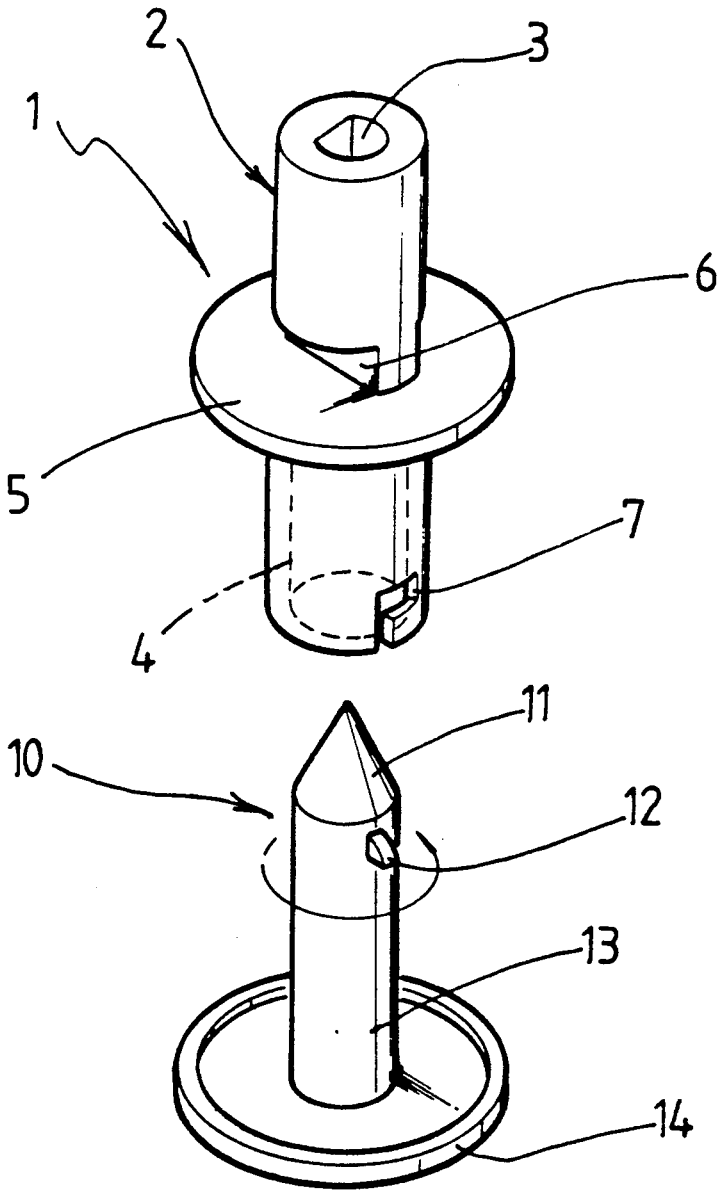
FIG. 1 is an exploded perspective view of a rotator structure according to the invention.

A rotating portion includes a driving shaft 1 and driven shaft 10 as shown in FIG. 1.

Figure 2:
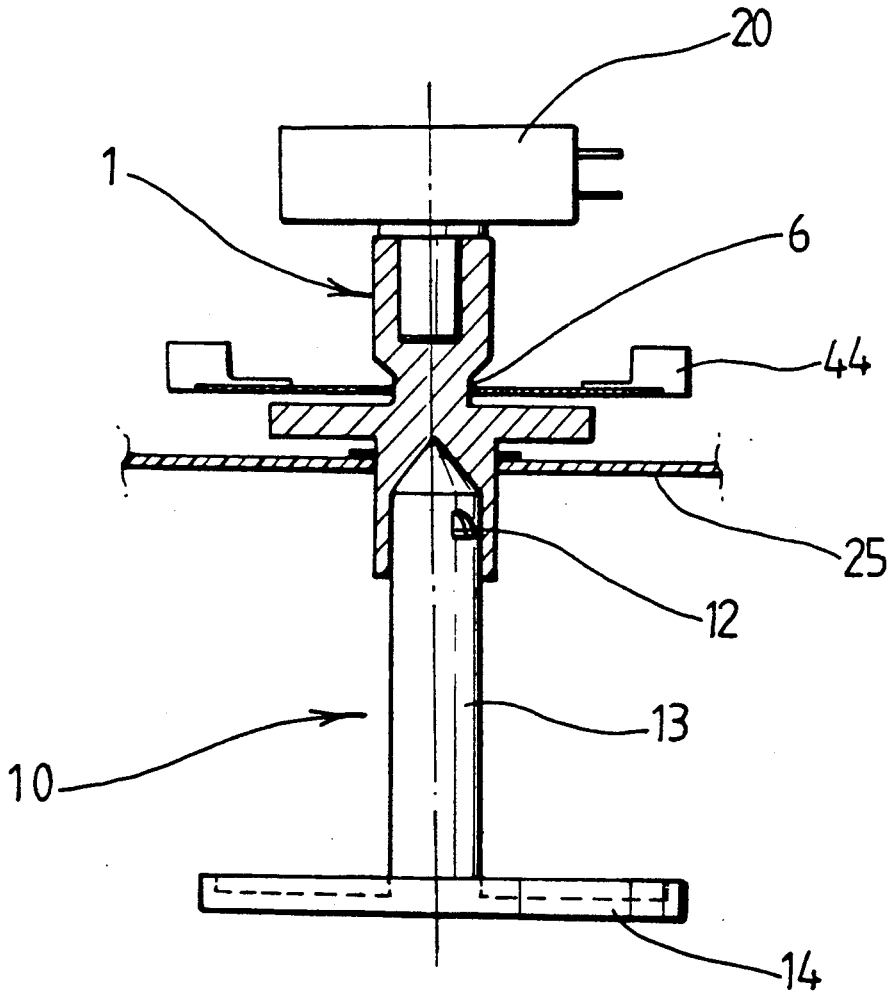
FIG. 2 is a assembled sectional view of a rotator structure according to the invention.

As FIG. 1 and FIG. 2 show, driving shaft 1 is provided with cylindrical mounting portion 2, at the middle portion of which circular supporter 5 is formed extending radially outward from the periphery of mounting portion 2 to have a predetermined area. Supporter 5 is positioned adjacent to and over lower ceiling plate 25*b* to support a stirrer as described below. Upper cavity 3 is formed downward from the upper portion of mounting portion 2 to a given depth to be connected to motor output shaft 22 which rotates about a stationary axis.

A coupling groove 6 for positioning stirrer 44 therein is formed over the upper surface of supporter 5 at the periphery of mounting portion 2. A lower cavity 4 extends from the middle portion to the lower portion of mounting portion 2 so as to permit the upper portion of driven shaft 10 to be inserted thereinto. A coupling recess 7 is formed at a predetermined width and extends upward from the lower end of mounting portion 2 and then toward the circumferential direction opposite to the rotation of motor 20 to define a hook shape so that it may be coupled with a supporting device 12 of driven shaft 10 as described below in detail.

Driven shaft 10 is provided with cylindrical retainer 13, an upper portion 11 of which is made conical to facilitate insertion into lower cavity 4. The lower portion of retainer 13 is provided with cooking disk 14 for placing foodstuffs thereon or receiving oil produced from foodstuffs during heating. Cooking disk 14 has a predetermined area in the form of a normal circular type, which is integrally fixed to the lower end of retainer 13.

Supporter 12 is projected at a predetermined distance away from upper portion 11 of retainer 13 to engage with coupling recess 7, which supporter projection 12 is integrally formed on the periphery of retainer 13.

Driving shaft 1 is made of materials having a relatively higher weight, such as a soft metal, to prevent the escape of driven shaft 10 from its coupling recess 7. The outer surface of driving shaft 1 is coated by materials, such as ceramics or porcelain, durable to the high temperature, and which does not affect microwaves.

As FIG. 3 shows, driving shaft 1 is arranged above the plate 25*a* in ceiling portion 25, inserting the center portion of stirrer 44 into coupling groove 6, suitably securing the stirrer to the mounting portion 2, and then mounting a teflon ring on the center of the upper face of stirrer 44. Stirrer 44 is simultaneously rotated with driving shaft 1. Driven shaft 10 is engaged with driving shaft 1, since supporter 12 is secured in coupling recess 7. At that time, driving shaft 1 is fixedly connected to motor shaft 22, so that it can rotate stirrer 40 with its driving force.

Therefore, the invention further need not have an air inlet formed in a ceiling portion because of the configuration of transferring the rotating force of a motor to a stirrer. In lieu of it, the cooking compartment may have an air inlet at a predetermined position in its wall to be introduced therein.

As a result, the capacity of a blowing fan motor for cooling a magnetron may be reduced because of the disassociation of a stirrer from a blowing fan motor, and the leakage of microwaves through an air inlet formed for rotating as the stirrer in a prior art may be avoided.

Also, according to the invention an electronic range can retain objects to be cooked, that is, the rotating member supports objects inserted thereon or placed on the cooking disk.

What is claimed is:

1. A microwave cooker comprising:

a cooking compartment, a motor having a housing and a rotary output which rotates about a stationary axis, shaft means driven by said rotary output, food supporting means for supporting food within said compartment and being mounted on said shaft means to be rotated thereby in spaced relation to said motor, and a microwave stirrer disposed between said motor and said food supporting means for dispersing microwaves, said stirrer mounted on said shaft means for being rotated thereby in spaced relation to said motor.

2. A microwave cooker according to claim 1, wherein said shaft means extends vertically.

3. A microwave cooker according to claim 1, wherein said shaft means comprises a driving shaft, and said food supporting means comprises a driven shaft removably connected to said driving shaft.

4. A microwave cooker according to claim 3, wherein said driving and driven shafts extend vertically, said motor disposed above said driving shaft.

5. A microwave cooker according to claim 4, wherein said driving shaft extends slightly into said compartment, said driven shaft terminating above a floor of said compartment.

6. A microwave cooker according to claim 5, wherein said driving shaft includes a downwardly opening cavity, said driven shaft being insertable upwardly into said cavity.

7. A microwave cooker according to claim 6, wherein said driving shaft includes a coupling recess having a downwardly opening longitudinal portion and a circumferential portion, said driven shaft including an outward projection insertable sequentially into said longitudinal portion and said circumferential portion, the weight of said food supporting means being transmitted to said driving shaft through said projection.

8. A microwave cooker according to claim 7, wherein said circumferential portion extends from an upper end of said longitudinal portion in a direction opposite a direction of rotation of said driving shaft.

9. A microwave cooker according to claim 7, wherein said driving shaft includes a groove for receiving said stirrer.

10. A microwave cooker according to claim 9, wherein said driving shaft includes a generally horizontal support disk supported at a lower end of said groove.

11. A microwave cooker according to claim 3, wherein said driven shaft includes a disk at its lower end for carrying food.

12. A microwave cooker according to claim 3, wherein said driving shaft includes a cavity at its upper end for receiving a motor shaft.

13. A microwave cooker according to claim 1, wherein said shaft means is driven about said stationary axis.

* * * * *